US006189222B1

(12) United States Patent
Doyle

(10) Patent No.: US 6,189,222 B1
(45) Date of Patent: Feb. 20, 2001

(54) ARTICULATED RAZOR HANDLE EXTENSION

(76) Inventor: Calvin M. Doyle, 10841 N. 29th Ave., Phoenix, AZ (US) 85029

( * ) Notice: Under 35 U.S.C. 154(b), the term of this patent shall be extended for 0 days.

(21) Appl. No.: 09/419,158

(22) Filed: Oct. 15, 1999

(51) Int. Cl.[7] ..... B26B 21/14; B26B 21/40

(52) U.S. Cl. ..... 30/531; 30/526; 30/527; 15/144.1

(58) Field of Search ..... 30/526, 527, 531, 30/537; D28/45, 46, 47, 48; 15/144.1

(56) References Cited

U.S. PATENT DOCUMENTS

| | | | | |
|---|---|---|---|---|
| 924,882 | * | 6/1909 | Boenker et al. | 30/144 |
| 1,711,413 | * | 4/1929 | Jansson | 30/526 |
| 1,749,051 | * | 3/1930 | Watt | 30/526 |
| 3,273,192 | * | 9/1966 | Mazzella | 15/144.1 |
| 3,773,375 | * | 11/1973 | Nehls | 15/144.1 |
| 3,964,160 | * | 6/1976 | Gordon | 30/531 |
| 4,905,372 | | 3/1990 | Willis . | |
| 5,093,991 | * | 3/1992 | Hendrickson | 30/531 |
| 5,167,069 | * | 12/1992 | Quinn | 30/527 |
| 5,704,127 | * | 1/1998 | Cordio | 30/526 |
| 5,911,480 | * | 6/1999 | Morgan | 30/526 |
| 6,032,321 | * | 3/2000 | Shirey et al. | 15/144.1 |

FOREIGN PATENT DOCUMENTS

163237 * 10/1948 (AT) .

* cited by examiner

*Primary Examiner*—Hwei-Siu Payer
(74) *Attorney, Agent, or Firm*—Frank J. McGue

(57) ABSTRACT

An articulated razor handle extension is disclosed which comprises a handle adapted to be grasped by a hand at one end thereof, and a gripping head adapted to engage a handle at the other end. The handle and the gripping head are joined by a plurality of shaft sections which are releasably connected by at least one spur gear assembly.

4 Claims, 2 Drawing Sheets

ARTICULATED RAZOR HANDLE EXTENSION

TECHNICAL FIELD

This invention relates to razor handle extensions, and, more particularly, razor handle extensions to be used interchangeably with various styles of shaving razors to permit an individual to shave body areas that are difficult for the user to reach.

BACKGROUND OF THE INVENTION

For various aesthetic and hygienic reasons, individuals have had the need to remove unsightly or unwanted hair from various parts of the body. Shaving razors are the most common and popular method by which this is accomplished. All shaving razors are currently designed with relatively short handles. If an individual is obese, elderly or has some degenerative ailment, such as arthritis, shaving hard to reach areas of the body or appendage extremities requires the user to assume uncomfortable, awkward positions. Such awkward positioning during shaving greatly increases risk of injury, particularly on wet slippery surfaces, such as a bathtub. Current designs preclude personal grooming of some body areas all together for such individuals.

U.S. pat. No. 4,905,372, Mar. 6, 1990 to Warren W. Willis, discloses a razor handle extension permitting a woman to reach the leg extremities without awkward bending. The drawbacks to this design are, first, that the razor handle extension is rigid and straight and, as a result, suited for reaching only limited areas of the body, specifically, the lower portions of the legs.

An additional disadvantage exists in the means by which the razor handle extension is joined to the razor. Willis' handle extension is designed with a clamping head that will accommodate various razor handle types. The clamping head has elongated arms that are pinched down onto the shaft of the razor handle by a small ring that snaps into place around the outside surface of the arms over retaining flanges. In the wet, slippery conditions such as occur when shaving, this clamping mechanism can be very difficult to operate. Moreover, a person with arthritic hands would likely find it nearly impossible to manage. Additionally, this clamping head does not provide a positive lock between razor handle and handle extension, thus allowing the shaving razor to shift position in relation to the longitudinal axis of the handle extension, increasing the difficulty of grooming hard to reach areas of the body. No other designs have been presented to overcome the aforementioned disadvantages.

SUMMARY OF THE INVENTION

It is one object of the present invention to provide an articulated razor handle extension that allows the user to adjust the angle of the shaving razor blade in relation to the longitudinal axis of the shaft of the handle extension to permit the user to shave normally inaccessible body areas.

It is another object of the invention to provide an articulated razor handle extension with a gripping head that allows for convenient, rapid removal and replacement of the shaving razor during actual use by the elderly, obese or those with degenerative ailments.

It is still another object of the invention to provide an articulated razor handle extension that can be lengthened or shortened as necessary by adding or removing interlocking shaft sections.

It is a further object of the invention to provide an articulated razor handle extension that can be produced in a variety of colors economically.

It is still further an object of the invention to provide an articulated razor handle extension that is not slippery or unwieldy when used in wet, soapy conditions.

Further objects and advantages is to provide an articulated razor handle extension which is light weight and yet rigid, easily collapsed down for storage or when taken while traveling, will not break or damage surfaces when dropped, and will accommodate a variety of shaving razor styles and designs from various manufacturers. Still further objects and advantages will become apparent from a consideration of the ensuing description and drawings.

DESCRIPTION OF THE PREFERRED EMBODIMENT

Figure 1:
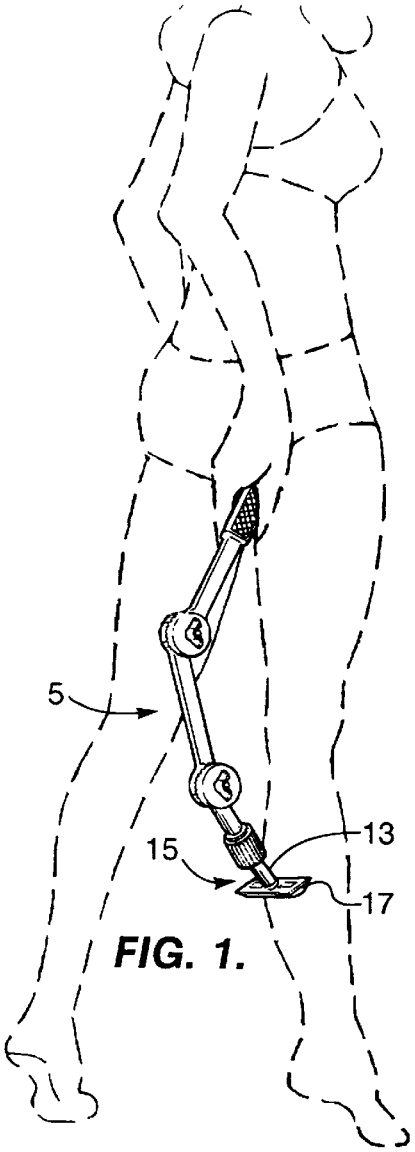
FIG. 1 illustrates the articulated razor handle extension of the present invention, having a shaving razor inserted in the gripping head, in use.

In accordance with the present invention, an articulated razor handle extension 5 comprises a handle 10 at one end for grasping, a gripping head 32 opposite handle 10 that provides a secure hold for a shaving razor handle 13 and one or more rigid shaft sections 18, 28 and 30 detachably connected by interlocking spur gear assemblies 20 interposed between handle 10 and gripping head 32.

In operation, shaving razor handle 13 is inserted into gripping head 32 of articulated razor handle extension 5. Gripping head 32 includes a hollow receiving barrel 46 surrounded by a plurality of flexible retaining fingers 40 and a threaded locking sleeve 33 which is screwed down over retaining fingers 40. Locking sleeve 33 has a conically shaped interior surface 34 along its longitudinal axis. Tightening locking sleeve 33 causes flexible retaining fingers 40 to rotate into engagement with and thereby releasably retain handle 13 of a shaving razor 15 which has been inserted into hollow receiving barrel 46 of gripping head 32. The angle of a blade 17 of shaving razor 15 is adjusted in relation to the longitudinal axis of articulated razor handle extension 5 by loosening a wing nut 26 on a threaded lug 24 that holds interlocking spur gear assemblies 20 together, adjusting the shaft angle to the desired degree, and retightening wing nut 26. Accordingly, an articulated razor handle extension is provided permitting infinite adjustment of the angle of shaving razor 15, thus allowing the user to shave previously hard to reach body areas comfortably and completely.

Details of articulated razor handle extension 5 are now disclosed while referencing FIGS. 2–6 of the drawings. The entirety of the articulated razor handle extension 5, interlocking spur gear assemblies 20 and gripping head 33 are preferably fabricated from a non-breakable rust resistant material such as plastic or the like. As is best shown in FIG.

Figures 2, 3, 4:
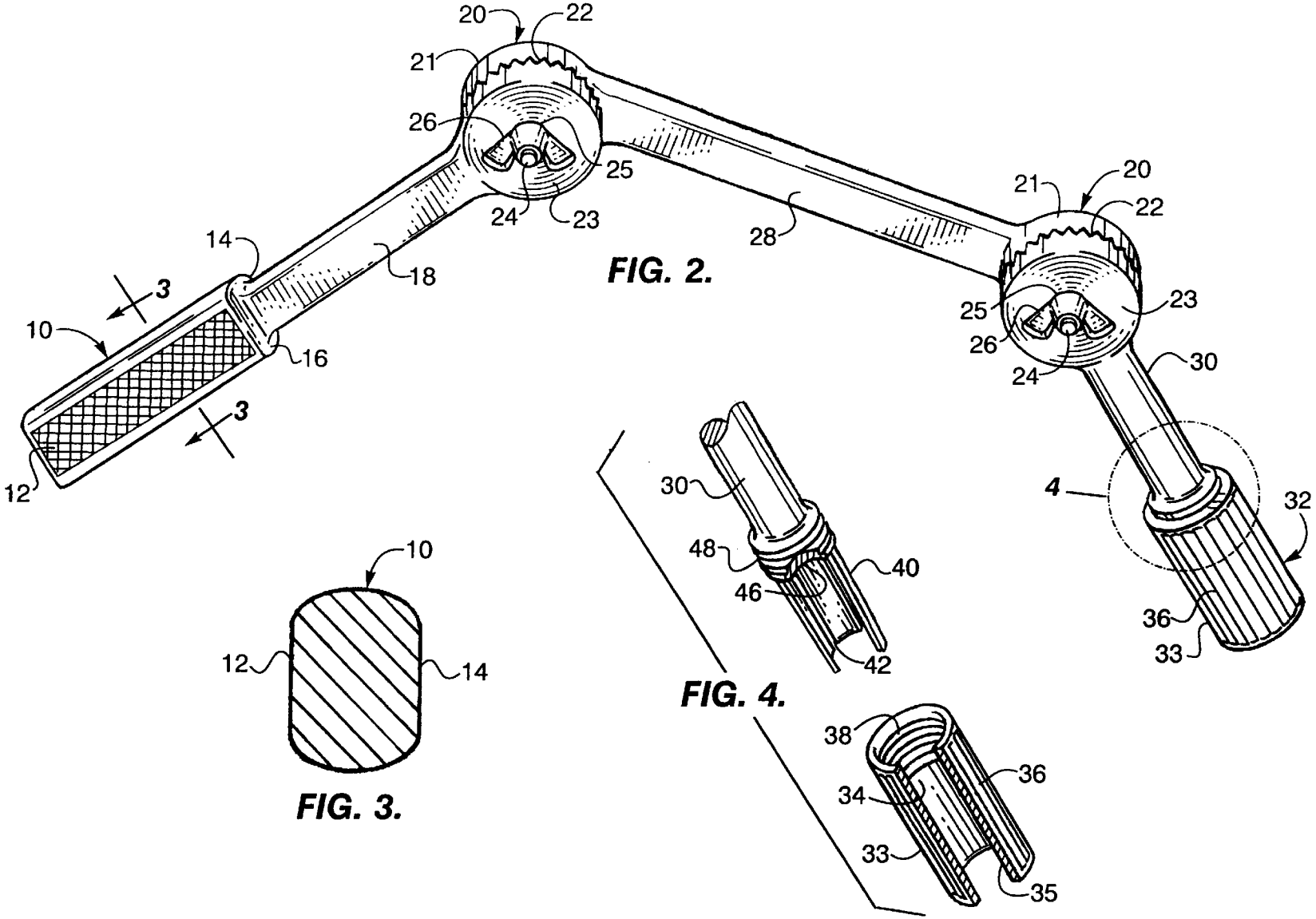
FIG. 2 is a cross section view of the articulated razor handle extension.
FIG. 3 is a cross section detail of the handle portion of the articulated razor handle extension of FIG. 2 taken along line 3—3.
FIG. 4 is an enlarged partial cross sectional view of the gripping head portion of the articulated razor extension of FIG. 2.

2, the presently preferred embodiment of articulated razor handle extension 5 is comprised of three shaft sections 18, 28, 30 connected together by interlocking spur gear assemblies 20, handle 10 at one end for grasping and gripping head 32 at the opposite end. As best seen in FIG. 3, handle 10 has a striated grip 12, and swaged sides 14, allowing the user to orient their hand in relation to the axial alignment of the shaving razor blade 17. The diameter of handle 10 is reduced by shoulder 16 at the juncture with shaft section 18, shaft section 18 integrally and coextensionally connecting handle 10 to a spur gear assembly 20.

Figure 5:
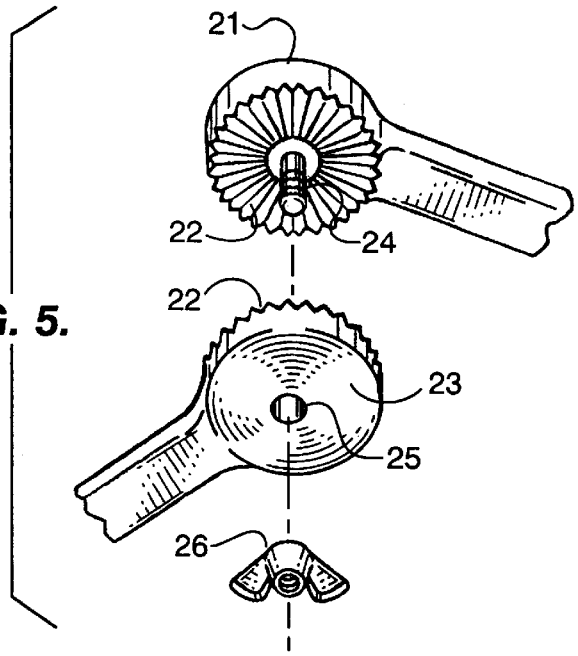
FIG. 5 is an enlarged exploded view of the interlocking spur gear joint of the articulated razor handle extension of FIG. 2.

As is best illustrated in FIG. 5, spur gear assembly 20 comprises a spur gear 21 having radial teeth 22 that mesh with corresponding radial teeth 22 on the opposite facing complimentary spur gear 23. Spur gear 23 includes a center bore 25 which receives a threaded lug 24 that is integral with the center face of spur gear 21. Wing nut 26 is tightened or loosened on said threaded lug 24, thus creating spur gear assembly 20 which is articulated and interlocking as between shaft section 18 and 28. Shaft sections 28 and 30 are interlocked in the same fashion as shaft sections 18 and 28.

Shaft section 30 is integrally and coextensionally joined to gripping head 32. As is best shown in FIG. 4, gripping head 32 includes an elongated generally cylindrical locking sleeve 33 which has a plurality of parallel aligned, axially extending ridges 36 on its exterior surface, thereby forming a non-slip surface and enabling the user to more reliably tighten or loosen locking sleeve 33 on shaving razor handle 15. The interior surface 35 of locking sleeve 33 has a female screw threaded portion 38 which is coextensionally connected to a conically shaped smooth surface portion 34, which tapers slightly (e.g. at an angle of 3 to 4 degrees) from base to top. Shaft section 30 terminates in a male threaded portion 48 and is coextensionally joined to the plurality of slightly tapered gripping fingers 40 around hollow barrel 46, said gripping fingers being formed by evenly spaced axially extending slots 42. Gripping fingers 40 taper slightly from base to top (e.g. at an angle of 2 to 3 degrees) and are characterized as having a spring-like memory. Locking sleeve 33 slides over gripping fingers 40 whereby female threaded portion 38 is brought into contact with complimentary male threaded portion 48 of shaft section 30. By rotating locking sleeve 33 in a clockwise direction, interior conical surface 34 is brought into contact with tapered gripping fingers 40, causing said gripping fingers 40 to press inwardly.

In operation, the user inserts handle 13 of a shaving razor 15 into receiving barrel 46 of gripping head 32 and rotates locking sleeve 33 in a clockwise direction, causing gripping fingers 40 to press inwardly into contact with shaving razor handle 13 thereby locking shaving razor 15 securely in place in gripping head 32. The user adjusts the angle of the shaving razor head 17 in relation to the axial alignment of shaft sections 28 and 18 by means of spur gear assemblies 20. Accordingly, an articulated razor handle extension 5 is provided permitting the user to shave various hard to reach body areas comfortably and safely. By rotating locking sleeve 33 in a counter clockwise direction, gripping fingers 40 are allowed to rotate away from handle 13 of shaving razor 15 and thereby releases from articulated razor handle extension 5.

Figure 6:
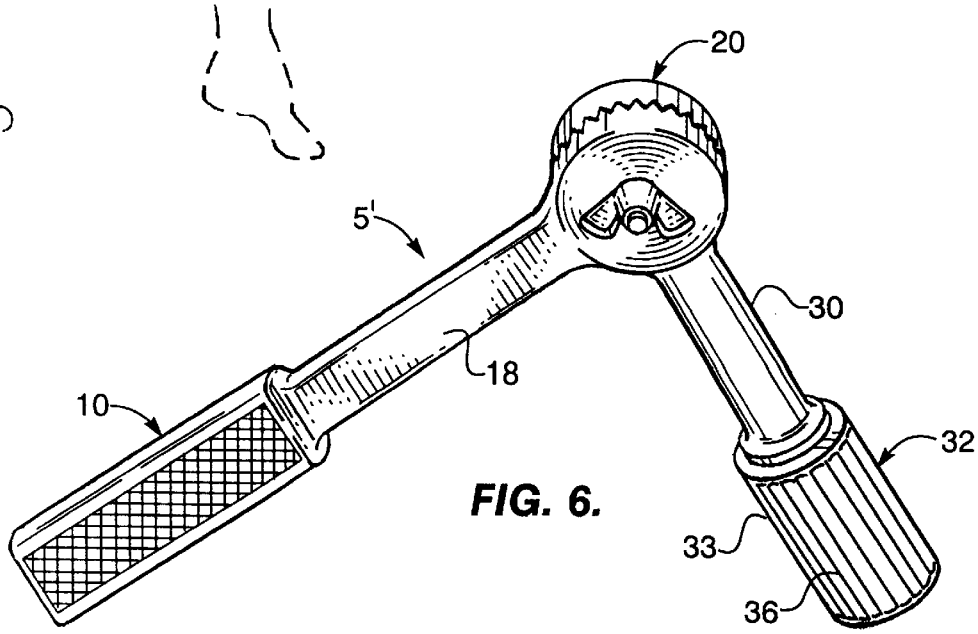
FIG. 6 illustrates an alternate embodiment of the articulated razor handle extension.

FIG. 6 shows an alternate embodiment of the articulated razor handle extension of FIGS. 1–5. This alternate embodiment of the articulated razor handle extension 5' has a handle 10 which is integrally and coextensionally connected to shaft section 18. Interlocking spur gear assembly 20 joins shaft section 18 to shaft section 30, said shaft section 30 being integrally and coextensionally connected to gripping head 32. The operation of articulated razor handle extension 5' of FIG. 6 is substantially identical to that of the preferred embodiment, as previously disclosed.

It will be apparent that while a preferred embodiment of the invention has been shown and described, various modifications may be made without departing from the true spirit and scope of the invention. For example, although articulated razor handle extension 5 is herewith presented holding shaving razor 15 for the purpose of extending its useable length, other devises could be clamped into articulated razor handle extension 5 and thus benefit the user by extending their effective reach. In addition, it can be seen that the articulating nature of handle extension 5 provides a much greater degree of versatility, allowing the user to groom any area of the body comfortably and safely. Lastly, while handle extension 5 is described with either 2 or 3 shaft sections, no added sections could be employed if desired.

Thus the scope of the invention should be determined by the appended claims and their legal equivalents, rather than by the examples given.

What is claimed is:

1. An articulated razor handle extension comprises a handle at one end adapted for grasping with a hand, a gripping head at the opposite end, said gripping head comprising a hollow barrel adapted to receive a shaving razor handle surrounded by a plurality of retaining fingers, which are in turn surrounded by a locking collar that, when rotated in a clockwise direction, brings said retaining fingers into contact with the shaving razor handle, thereby releasably retaining the shaving razor handle in the gripping head, the handle and the gripping head being joined together by a plurality of shaft sections which are releasably connected to each other by at least one interlocking spur gear assembly.

2. The articulated razor handle extension recited in claim 1 wherein said interlocking spur gear assembly is comprised of meshing spur gears releasably retained in interface by a threaded lug centrally located on the face of one spur gear and a complementary central through bore for receiving said threaded lug in the opposite facing spur gear and a wing nut which is screwed on said threaded lug, thereby permitting articulation of adjacent shaft sections when said wing nut is loosened.

3. The articulated razor handle extension recited in claim 1 comprising three shaft sections joined by two spur gear assemblies.

4. The articulated razor handle extension recited in claim 1 the plurality of shaft sections comprises two shaft sections joined by said at least one spur gear assembly.

* * * * *